US008887691B2

(12) United States Patent
Chen et al.

(10) Patent No.: US 8,887,691 B2
(45) Date of Patent: Nov. 18, 2014

(54) METHOD AND APPARATUS FOR SELECTING A COMBUSTION MODE FOR AN INTERNAL COMBUSTION ENGINE

(75) Inventors: Jyh-Shin Chen, Troy, MI (US); Jun-Mo Kang, Ann Arbor, MI (US); Chen-Fang Chang, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 477 days.

(21) Appl. No.: 11/736,128

(22) Filed: Apr. 17, 2007

(65) Prior Publication Data

US 2008/0257306 A1 Oct. 23, 2008

(51) Int. Cl.
*F02B 15/00* (2006.01)
*F02B 5/00* (2006.01)
*F02D 41/30* (2006.01)

(52) U.S. Cl.
USPC ..... 123/305; 123/681

(58) Field of Classification Search
USPC ..... 123/295, 299, 305, 350, 681, 682
See application file for complete search history.

(56) References Cited

U.S. PATENT DOCUMENTS 6,390,054 B1 * 5/2002 Yang ..... 123/295
6,497,213 B2 * 12/2002 Yoshizawa et al. ..... 123/299
6,615,771 B2 * 9/2003 Denger et al. ..... 123/21
6,619,255 B2 * 9/2003 Urushihara et al. ..... 123/295
6,637,404 B2 * 10/2003 Fuerhapter et al. ..... 123/305
6,662,785 B1 12/2003 Sloane et al.
6,668,790 B2 * 12/2003 Chmela et al. ..... 123/295
6,725,825 B1 * 4/2004 Kurtz et al. ..... 123/295
6,957,640 B1 * 10/2005 Liu et al. ..... 123/305
6,964,256 B2 * 11/2005 Kataoka et al. ..... 123/295
6,971,365 B1 12/2005 Najt et al.
6,994,072 B2 2/2006 Kuo et al.
7,021,276 B2 * 4/2006 Liu et al. ..... 123/299
7,059,281 B2 6/2006 Kuo et al.
7,080,613 B2 7/2006 Kuo et al.
7,082,898 B2 8/2006 Kitamura et al.
7,089,908 B2 * 8/2006 Fujieda et al. ..... 123/299
7,121,233 B2 * 10/2006 Kitamura et al. ..... 123/27 R
7,121,255 B2 * 10/2006 Liu et al. ..... 123/305
7,128,062 B2 10/2006 Kuo et al.
7,168,420 B1 * 1/2007 Yang ..... 123/568.15
7,194,996 B2 * 3/2007 Koopmans ..... 123/295

(Continued)

FOREIGN PATENT DOCUMENTS

JP 2000-320333 A 11/2000
JP 2001-003800 A 1/2001

(Continued)

*Primary Examiner* — Stephen K Cronin
*Assistant Examiner* — Arnold Castro

(57) ABSTRACT

A method for selecting a preferred combustion mode for an internal combustion engine operative in a plurality of combustion modes is described. The method includes selecting a combustion mode in terms of first and second engine parameters, and separating the engine operating region into zones defined by the first parameter. Each of the zones is further separated into sub-zones defined by the second parameter. A combustion mode is associated with each of the sub-zones. Operating states are determined for the first and second parameters. One of the zones is identified based upon the state for the first parameter. One of the sub-zones of the identified zone is identified based upon the state for the second parameter, along with a combustion mode associated with the identified sub-zone. The engine is controlled to the preferred combustion mode, depending upon hysteresis.

17 Claims, 3 Drawing Sheets

(56) References Cited

U.S. PATENT DOCUMENTS

| | | | | |
|---|---|---|---|---|
| 7,210,457 | B2 * | 5/2007 | Kuzuyama | 123/435 |
| 7,213,572 | B2 * | 5/2007 | Yang | 123/406.11 |
| 7,234,438 | B2 * | 6/2007 | Yang | 123/295 |
| 7,240,659 | B2 * | 7/2007 | Yang | 123/295 |
| 7,263,968 | B2 * | 9/2007 | Cairns et al. | 123/295 |
| 7,367,310 | B2 * | 5/2008 | Kakuya et al. | 123/295 |
| 7,469,672 | B2 * | 12/2008 | Andri | 123/198 F |
| 2002/0121263 | A1 * | 9/2002 | Chmela et al. | 123/295 |
| 2003/0230276 | A1 * | 12/2003 | Kataoka et al. | 123/295 |
| 2004/0084010 | A1 * | 5/2004 | Kurtz et al. | 123/295 |
| 2004/0129245 | A1 * | 7/2004 | Hitomi et al. | 123/299 |
| 2005/0211218 | A1 * | 9/2005 | Liu et al. | 123/299 |
| 2005/0288846 | A1 * | 12/2005 | Liu et al. | 701/104 |
| 2006/0174853 | A1 * | 8/2006 | Koopmans | 123/295 |
| 2006/0196466 | A1 | 9/2006 | Kuo et al. | |
| 2006/0196467 | A1 | 9/2006 | Kang et al. | |
| 2006/0196468 | A1 | 9/2006 | Chang et al. | |
| 2006/0196469 | A1 | 9/2006 | Kuo et al. | |
| 2006/0219214 | A1 * | 10/2006 | Okude et al. | 123/299 |
| 2006/0236958 | A1 | 10/2006 | Sun et al. | |
| 2006/0243241 | A1 | 11/2006 | Kuo et al. | |
| 2007/0062483 | A1 * | 3/2007 | Yang | 123/295 |
| 2007/0062484 | A1 * | 3/2007 | Yang | 123/295 |
| 2007/0062486 | A1 * | 3/2007 | Yang | 123/305 |
| 2007/0204830 | A1 * | 9/2007 | Andri | 123/198 F |
| 2007/0215095 | A1 * | 9/2007 | Kakuya et al. | 123/295 |
| 2008/0066459 | A1 * | 3/2008 | O'Neill | 60/324 |
| 2008/0066713 | A1 * | 3/2008 | Megli et al. | 123/295 |

FOREIGN PATENT DOCUMENTS

| | | | |
|---|---|---|---|
| JP | 2006-046303 | A | 2/2006 |
| JP | 2007-040235 | A | 2/2007 |
| JP | 2007-064210 | A | 3/2007 |

* cited by examiner

METHOD AND APPARATUS FOR SELECTING A COMBUSTION MODE FOR AN INTERNAL COMBUSTION ENGINE

TECHNICAL FIELD

This invention relates to operation and control of internal combustion engines, and more particularly to engines selectively operative in a homogeneous-charge compression-ignition mode.

BACKGROUND OF THE INVENTION

The statements in this section merely provide background information related to the present disclosure and may not constitute prior art.

Internal combustion engines, especially automotive internal combustion engines, generally fall into one of two categories, spark ignition engines and compression ignition engines. Traditional spark ignition engines, such as gasoline engines, typically function by introducing a fuel/air mixture into the combustion cylinders, which is then compressed in the compression stroke and ignited by a spark plug. Traditional compression ignition engines, such as diesel engines, typically function by introducing or injecting pressurized fuel into a combustion cylinder near top dead center (TDC) of the compression stroke, which ignites upon injection. Combustion for both traditional gasoline engines and diesel engines involves premixed or diffusion flames that are controlled by fluid mechanics. Each type of engine has advantages and disadvantages. In general, gasoline engines produce fewer emissions but are less efficient, while, in general, diesel engines are more efficient but produce more emissions.

More recently, other types of combustion methodologies have been introduced for internal combustion engines. One of these combustion concepts is known in the art as the homogeneous charge compression ignition (HCCI). The HCCI combustion mode comprises a distributed, flameless, auto-ignition combustion process that is controlled by oxidation chemistry, rather than by fluid mechanics. In a typical engine operating in HCCI combustion mode, the cylinder charge is nearly homogeneous in composition, temperature, and residual level at intake valve closing time. Because auto-ignition is a distributed kinetically-controlled combustion process, the engine operates at a very dilute fuel/air mixture (i.e., lean of a fuel/air stoichiometric point) and has a relatively low peak combustion temperature, thus forming extremely low $NO_x$ emissions. The fuel/air mixture for auto-ignition is relatively homogeneous, as compared to the stratified fuel/air combustion mixtures used in diesel engines, and, therefore, the rich zones that form smoke and particulate emissions in diesel engines are substantially eliminated. Because of this very dilute fuel/air mixture, an engine operating in the auto-ignition combustion mode can operate unthrottled to achieve diesel-like fuel economy.

At medium engine speed and load, a combination of valve profile and timing (e.g., exhaust recompression and exhaust re-breathing) and fueling strategy has been found to be effective in providing adequate heating to the cylinder charge so that auto-ignition during the compression stroke leads to stable combustion with low noise. One of the main issues in effectively operating an engine in the auto-ignition combustion mode has been to control the combustion process properly so that robust and stable combustion resulting in low emissions, optimal heat release rate, and low noise can be achieved over a range of operating conditions. The benefits of auto-ignition combustion have been known for many years.

The primary barrier to product implementation, however, has been the inability to control the auto-ignition combustion process.

To address issues related to combustion stability, HCCI engines operate at different combustion modes, depending upon specific engine operating conditions. The different combustion modes include various spark-ignition modes and auto-ignition modes.

It is desirable, therefore, to select and control engine operation in a combustion mode which achieves robust and stable combustion, low emissions, optimal heat release rate, and low noise, over the range of engine operating conditions. Selection and control of engine operation in a specific combustion mode preferably includes relatively fast decision-making to maintain optimum combustion over the entire engine operating range.

The invention described hereinafter comprises a method and a control scheme to determine a preferred combustion mode for operating the engine, and controlling the engine thereto.

SUMMARY OF THE INVENTION

In accordance with an embodiment of the invention, there is provided a method for selecting a preferred combustion mode for an internal combustion engine selectively operative in a plurality of combustion modes. The method includes defining engine operation in terms of first and second engine parameters, and separating the engine operation into zones defined by the first parameter. Each of the zones is further separated into sub-zones defined by the second parameter. A combustion mode is associated with each of the sub-zones. Operating states are determined for the first and second parameters. One of the zones is identified based upon the state for the first parameter. One of the sub-zones of the identified zone is identified based upon the state for the second parameter, and, a preferred combustion mode is identified based upon the combustion mode associated with the identified sub-zone. The engine is selectively controlled to the preferred combustion mode, depending upon hysteresis.

These and other aspects of the invention are described hereinafter with reference to the drawings and the description of the embodiments

DESCRIPTION OF THE DRAWINGS

The invention may take physical form in certain parts and arrangement of parts, the embodiments of which are described in detail and illustrated in the accompanying drawings which form a part hereof, and wherein.

DESCRIPTION OF AN EMBODIMENT OF THE INVENTION

Figure 1:
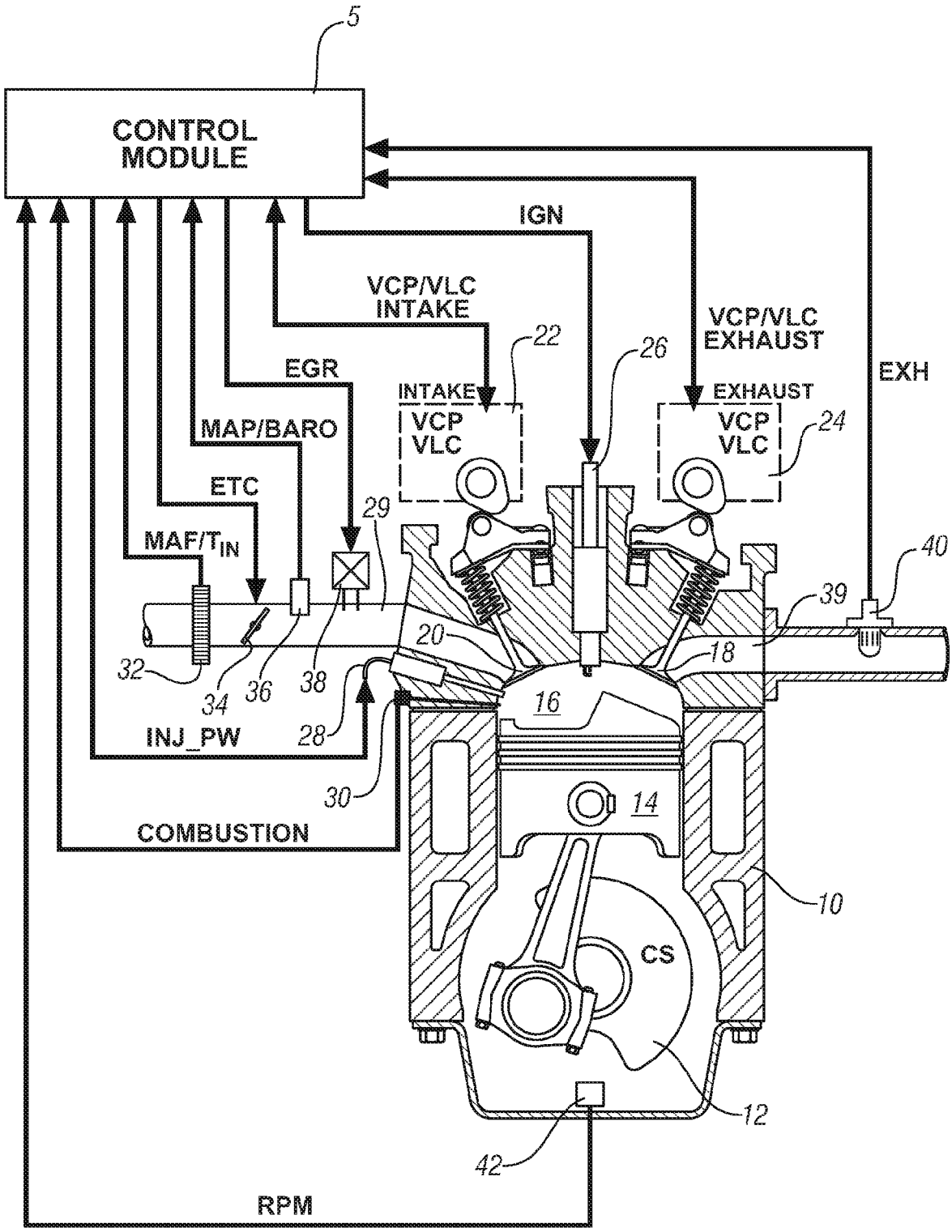
FIG. 1 is a schematic drawing of an engine system, in accordance with the present invention.

Referring now to the drawings, wherein the depictions are for the purpose of illustrating the invention only and not for the purpose of limiting the same, FIG. 1 depicts a schematic diagram of an internal combustion engine 10 and accompanying control module 5 that have been constructed in accordance with an embodiment of the invention.

The exemplary engine 10 comprises a multi-cylinder direct-injection four-stroke internal combustion engine having reciprocating pistons 14 slidably movable in cylinders which define variable volume combustion chambers 16. Each of the pistons is connected to a rotating crankshaft 12 ('CS') by which their linear reciprocating motion is translated to rotational motion. There is an air intake system which provides intake air to an intake manifold which directs and distributes the air into an intake runner 29 to each combustion chamber 16. The air intake system comprises airflow ductwork and devices for monitoring and controlling the air flow. The devices preferably include a mass airflow sensor 32 for monitoring mass airflow ('MAF') and intake air temperature ('$T_{IN}$'). There is a throttle valve 34, preferably an electronically controlled device which controls air flow to the engine in response to a control signal ('ETC') from the control module. There is a pressure sensor 36 in the manifold adapted to monitor manifold absolute pressure ('MAP') and barometric pressure ('BARO'). There is an external flow passage for recirculating exhaust gases from engine exhaust to the intake manifold, having a flow control valve, referred to as an exhaust gas recirculation ('EGR') valve 38. The control module 5 is operative to control mass flow of exhaust gas to the engine air intake by controlling opening of the EGR valve.

Air flow from the intake runner 29 into each of the combustion chambers 16 is controlled by one or more intake valves 20. Flow of combusted gases from each of the combustion chambers to an exhaust manifold via exhaust runners 39 is controlled by one or more exhaust valves 18. Openings and closings of the intake and exhaust valves are preferably controlled with a dual camshaft (as depicted), the rotations of which are linked and indexed with rotation of the crankshaft 12. The engine is equipped with devices for controlling valve lift of the intake valves and the exhaust valves, referred to as variable lift control ('VLC'). The variable valve lift system comprises devices operative to control valve lift, or opening, to one of two distinct steps, e.g., a low-lift valve opening (about 4-6 mm) for load speed, low load operation, and a high-lift valve opening (about 8-10 mm) for high speed and high load operation. The engine is further equipped with devices for controlling phasing (i.e., relative timing) of opening and closing of the intake valves and the exhaust valves, referred to as variable cam phasing ('VCP'), to control phasing beyond that which is effected by the two-step VLC lift. There is a VCP/VLC system 22 for the engine intake and a VCP/VLC system 24 for the engine exhaust. The VCP/VLC systems 22, 24 are controlled by the control module, and provide signal feedback to the control module consisting of camshaft rotation position for the intake camshaft and the exhaust camshaft. When the engine is operating in an auto-ignition mode with exhaust recompression valve strategy the low lift operation is typically used, and when the engine is operating in a spark-ignition combustion mode the high lift operation typically is used. As known to skilled practitioners, VCP/VLC systems have a limited range of authority over which opening and closings of the intake and exhaust valves can be controlled. Variable cam phasing systems are operable to shift valve opening time relative to crankshaft and piston position, referred to as phasing. The typical VCP system has a range of phasing authority of 30°-50° of cam shaft rotation, thus permitting the control system to advance or retard opening and closing of the engine valves. The range of phasing authority is defined and limited by the hardware of the VCP and the control system which actuates the VCP. The VCP/VLC system is actuated using one of electro-hydraulic, hydraulic, and electric control force, controlled by the control module 5.

The engine includes a fuel injection system, comprising a plurality of high-pressure fuel injectors 28 each adapted to directly inject a mass of fuel into one of the combustion chambers, in response to a signal ('INJ_PW') from the control module. The fuel injectors 28 are supplied pressurized fuel from a fuel distribution system (not shown).

The engine includes a spark ignition system by which spark energy is provided to a spark plug 26 for igniting or assisting in igniting cylinder charges in each of the combustion chambers, in response to a signal ('IGN') from the control module. The spark plug 26 enhances the ignition timing control of the engine at certain conditions (e.g., during cold start and near a low load operation limit).

The engine is equipped with various sensing devices for monitoring engine operation, including a crankshaft rotational speed sensor 42 having output RPM, a sensor 30 adapted to monitor combustion having output COMBUSTION, and, a sensor 40 adapted to monitor exhaust gases having output EXH, typically a wide range air/fuel ratio sensor. The combustion sensor comprises a sensor device operative to monitor a combustion parameter and is depicted as a cylinder pressure sensor to monitor in-cylinder combustion pressure. It is understood that other sensing systems used to monitor cylinder pressure or another combustion parameter which can be translated into combustion phasing are included within the scope of the invention, e.g., ion-sense ignition systems.

The engine is designed to operate un-throttled on gasoline or similar fuel blends with auto-ignition combustion over an extended range of engine speeds and loads. However spark ignition and throttle-controlled operation may be utilized with conventional or modified control methods under conditions not conducive to auto-ignition operation and to obtain maximum engine power to meet an operator torque request. Fueling preferably comprises direct fuel injection into the each of the combustion chambers. Widely available grades of gasoline and light ethanol blends thereof are preferred fuels; however, alternative liquid and gaseous fuels such as higher ethanol blends (e.g. E80, E85), neat ethanol (E99), neat methanol (M100), natural gas, hydrogen, biogas, various reformates, syngases, and others may be used in the implementation of the present invention.

The control module 5 is preferably a general-purpose digital computer generally comprising a microprocessor or central processing unit, storage mediums comprising non-volatile memory including read only memory (ROM) and electrically programmable read only memory (EPROM), random access memory (RAM), a high speed clock, analog to digital (A/D) and digital to analog (D/A) circuitry, and input/output circuitry and devices (I/O) and appropriate signal conditioning and buffer circuitry. The control module has a set of control algorithms, comprising resident program instructions and calibrations stored in the non-volatile memory and executed to provide the respective functions of each computer. The algorithms are typically executed during preset loop cycles such that each algorithm is executed at least once each loop cycle. Algorithms are executed by the central processing unit and are operable to monitor inputs from the aforementioned sensing devices and execute control and diagnostic routines to control operation of the actuators, using preset calibrations. Loop cycles are typically executed at regular intervals, for example each 3.125, 6.25, 12.5, 25 and 100 milliseconds during ongoing engine and vehicle operation. Alternatively, algorithms may be executed in response to occurrence of an event.

The control module 5 executes algorithmic code stored therein to control the aforementioned actuators to control engine operation, including throttle position, spark timing, fuel injection mass and timing, intake and/or exhaust valve timing and phasing, and EGR valve position to control flow of recirculated exhaust gases. Valve timing and phasing includes negative valve overlap (NVO in an exhaust recompression strategy) and lift of exhaust valve reopening (in an exhaust re-breathing strategy). The control module is adapted to receive input signals from an operator (e.g., a throttle pedal position and a brake pedal position) to determine an operator torque request ($T_{O_REQ}$) and from the sensors indicating the engine speed (RPM) and intake air temperature ($T_{IN}$), and coolant temperature and other ambient conditions. The control module 5 operates to determine, from lookup tables in memory, instantaneous control settings for spark timing (as needed), EGR valve position, intake and exhaust valve timing and/or lift set points, and fuel injection timing, and calculates the burned gas fractions in the intake and exhaust systems.

The invention described herein comprises a method for identifying a preferred engine combustion mode, and controlling operation of the engine in the preferred engine combustion mode. This comprises selecting a combustion mode in terms of first and second engine parameters, e.g., engine speed and load. The engine operating region is separated into a plurality of zones based upon the first parameter. Each of the zones separated into a plurality of sub-zones based upon the second parameter, and one of the combustion modes is associated with each of the sub-zones.

Referring now to FIG. 2, the exemplary engine is selectively operative in one of the combustion modes, based upon states of engine parameters, in this embodiment comprising speed (RPM) and load (LOAD) derivable from engine operating parameters such as engine fuel flow (INJ-PW in milligrams), or manifold pressure (MAP).

Figure 2A:
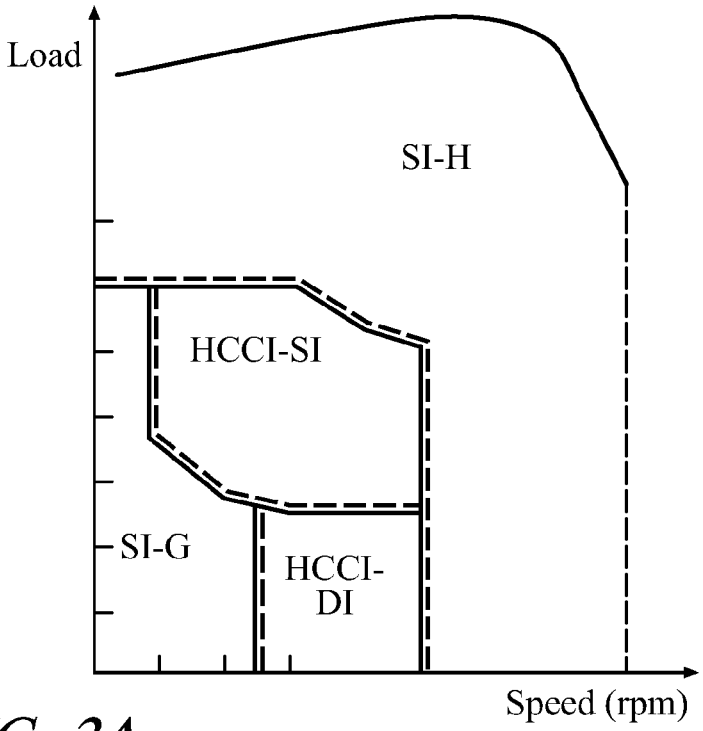
FIGS. 2A, 2B, and 3 are data graphs, in accordance with the present invention; and, FIG. 4 is an algorithmic flowchart, in accordance with the present invention.
Figure 2B:
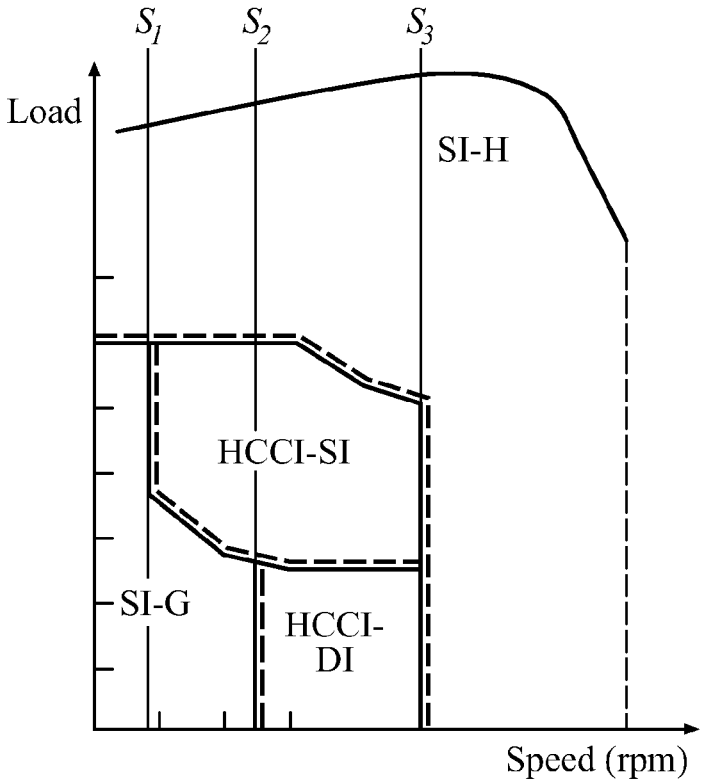

As depicted in FIGS. 2A and 2B, the engine combustion modes comprise a spray-guided spark-ignition (SI-G) mode, a single injection controlled auto-ignition (HCCI-SI) mode, and double injection controlled auto-ignition (HCCI-DI) mode, and a homogeneous spark-ignition (SI-H) mode. A preferred speed and load operating range for each of the combustion modes is based upon optimum engine operating parameters, including combustion stability, fuel consumption, emissions, engine torque output, and others. Boundaries which define the preferred speed and load operating ranges to delineate the combustion modes are typically determined during pre-production engine calibration and development, and are executed in the engine control module as zones and sub-zones, described hereinafter. In the embodiment described, the speed operating range is divided into four zones as show in FIG. 2A. There is a first zone, defined by engine speed ranging from a minimum idle speed to a first speed threshold, S1, which is defined by a minimum engine speed for HCCI-SI mode. There is a second zone, defined by engine speed ranging from the first speed threshold, S1 to the second speed threshold, S2. The second speed threshold, S2, is defined by a maximum engine speed for SI-G operation. There is a third zone, defined by engine speed ranging from the second speed threshold, S2, to the third speed threshold, S3, which is defined by a maximum engine speed for auto-ignition operation. There is a fourth zone, defined by engine speed ranging above the third speed threshold, S3.

Referring again to FIG. 2A, each of the zones defined by the speed parameter is divided into sub-zones, based upon engine load. The first zone is divided into two sub-zones at a load point defined by capacity of the engine to operate in the SI-G mode, such that when the engine load is below the load point, the preferred combustion mode comprises the SI-G mode, whereas when the engine load is above the load point, the preferred combustion mode comprises the SI-H mode. The second zone is divided into three sub-zones, at load points defined by capability of the engine to operate in the HCCI-SI mode. When the engine is operating in the second zone, at low load conditions, the SI-G combustion mode is commanded; at medium load conditions, the HCCI-SI combustion mode is commanded; and, at high load conditions, the SI-H combustion mode is commanded. The third zone is divided into three sub-zones, at load points defined by capability of the engine to operate in the HCCI-SI mode. When the engine is operating in the third zone, at low load conditions, the HCCI-DI combustion mode is commanded; at medium load conditions, the HCCI-SI combustion mode is commanded; and, at high load conditions, the SI-H combustion mode is commanded. When the engine is operating in the fourth zone, the SI-H mode is commanded, regardless of engine load. The control scheme for controlling engine operation in one of the combustion modes employs hysteresis around the speed thresholds and load points to prevent unnecessary transitioning and dithering when the engine operation is near one of the speed thresholds or load points. Thus, although a preferred combustion mode may be identified, the control module may delay or completely ignore a command to transition out of one combustion mode to a second combustion mode, as a result of hysteresis.

For the typical HCCI engine, the speed/load operating region for each mode is not necessarily rectangular. Each of the boundaries includes hysteresis, to avoid back and forth oscillation between two combustion modes when the engine is operating near one of the boundaries. The described method, executed as an algorithm, selects the preferred combustion mode for a given engine operation defined by speed and load. The algorithm is relatively efficient and easy to implement.

The HCCI-SI mode comprises a single fuel injection pulse per combustion cycle that is timely injected for auto-ignition combustion, and is preferably employed at medium range engine speed and load conditions. The HCCI-DI mode comprises dual fuel injection pulses per combustion cycle, including an early reforming pulse of fuel during negative valve overlap period caused by controlling actuation of the intake and exhaust valve timing. This is followed by a main pulse of fuel injected for auto-ignition combustion, and is preferably employed at low loads and medium engine speed conditions. When operating in either of the auto-ignition modes, the engine is preferably controlled to operate at an air/fuel ratio that is lean of stoichiometry with the engine throttle at a wide-open throttle position to minimize engine pumping losses. The SI-G mode comprises timely injection of fuel concurrent with spark-ignition energy, and is preferably used at off-idle engine speeds and low to medium engine loads. The SI-H mode comprises early injection of fuel to form a homogeneous combustion charge prior to igniting the spark plug and is preferably used at medium to high engine speed and load conditions. When operating in either of the spark-ignition modes, the engine is preferably controlled to a stoichiometric air/fuel ratio with the throttle partially closed based upon engine conditions and the operator torque request.

In operation the control module preferably includes a pre-programmed calibration table or equations which provide the speed thresholds and load points which comprise the boundaries for transitioning between the combustion modes. Engine operation is monitored to determine engine states defined by the first and second parameters. One of the plurality of zones is identified based upon the engine state for the first parameter, i.e., speed. One of the sub-zones of the identified zone is then identified based upon the engine state for the second parameter. A preferred combustion mode is identified based upon the combustion mode associated with the identified sub-zone. Engine operation is controlled in the preferred combustion mode.

Figure 3:
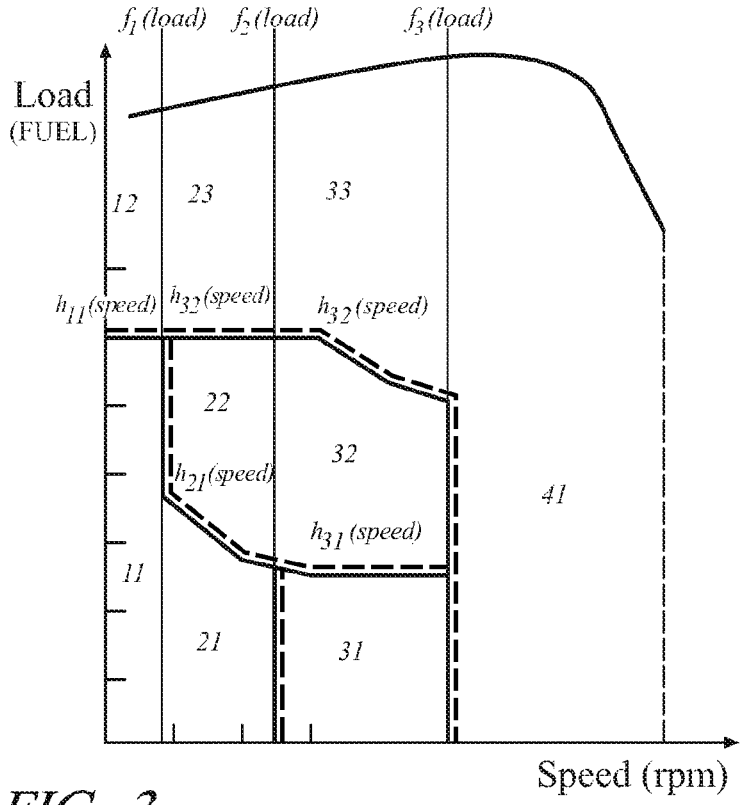
Figure 4:
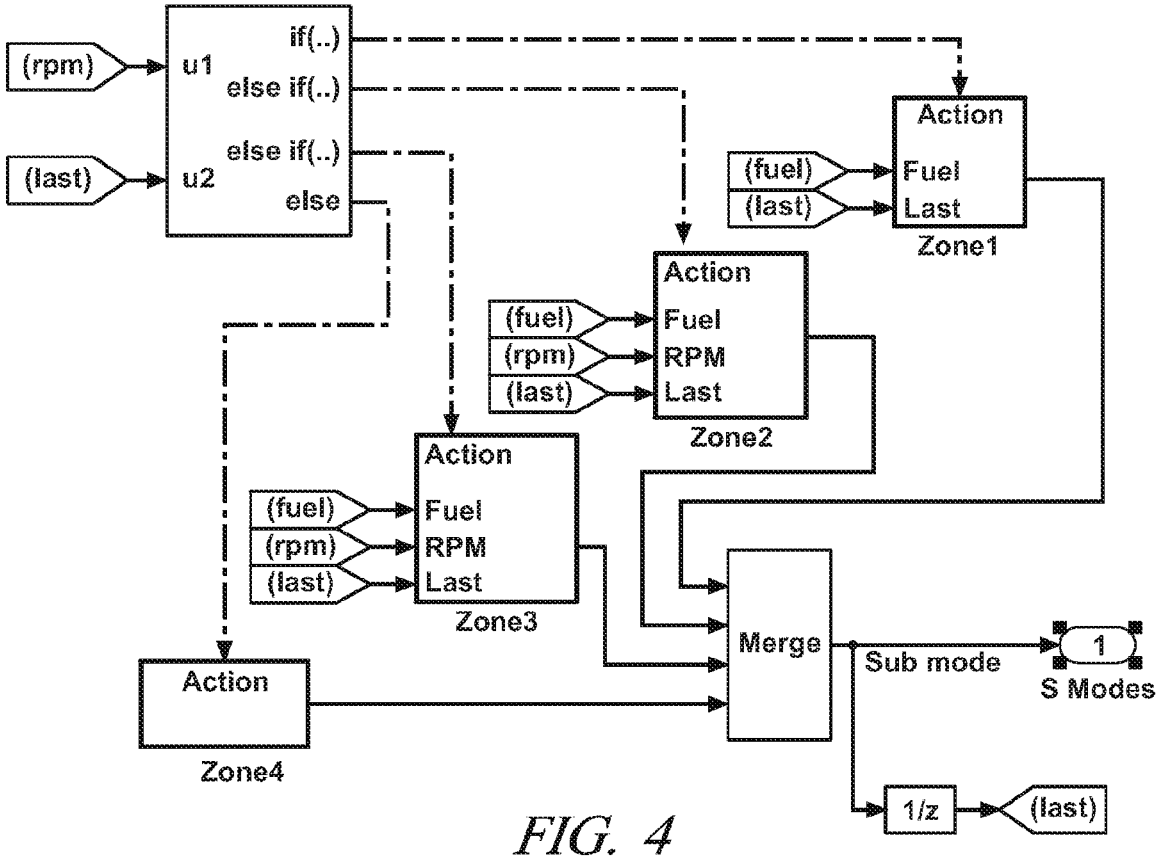

Referring now to FIGS. 3 and 4, an exemplary control scheme is now described, in accordance with the invention. The control scheme is depicted with reference to FIG. 4, and is executed as one or more algorithms in the control module. The data graph of FIG. 3 depicts a predetermined calibration which delineates boundaries to define the preferred speed (rpm) and load (fuel) operating ranges for the combustion modes, comprising zones and sub-zones. The boundaries are described based upon engine load, $f_i$(load), with each speed zone further separated into sub-zones based on the remaining independent variable, i.e., load in this example. The boundary of each sub-zone is described as a function of speed, $h_{ij}$ (RPM). In the depiction, four zones are defined based upon speed, identified by numerals 1, 2, 3, and 4. The sub-zones are also defined by numerals, resulting in sub-zones of 11, 12, 21, 22, 23, 31, 32, 33, and 41. The numerals assigned to each of the sub-zones are specific and intentional, as they are used in the logic equations described hereinbelow and as depicted with reference to FIG. 4. Each of the sub-zones has a preferred engine combustion mode associated therewith, as follows: 11: SI-G; 12: SI-H; 21: SI-G; 22: HCCI-SI; 23: SI-H; 31: HCCI-DI; 32: HCCI-SI; 33: SI-H; and 41: SI-H. Hysteresis values for speed and load are pre-defined, comprising $r_i$ and $s_i$, which are small positive numbers, for example, in the range of 50-100 rpm for engine speed, and 2-5 kPa for engine load. A variable, defined as 'last', comprises the engine operating mode determined during the last cycle, i.e., the engine operating mode commanded by the most recent execution of the algorithm described herein.

Referring again to FIG. 4, the control scheme includes decision logic, executed as algorithmic code, to determine the preferred engine operating mode based upon the engine speed and load, utilizing the predetermined calibration which delineates boundaries to define the preferred speed (rpm) and load (fuel) operating ranges for the combustion modes, comprising zones and sub-zones, with the assigned numerals as described. A variable, defined as 'last', comprises the engine operating mode determined during the last cycle, i.e., the engine operating mode commanded by the most recent execution of the algorithm described herein. In the embodiment, the engine speed is depicted in terms of 'rpm', and the engine load is depicted in terms of 'fuel'. Thus, for a given operating speed (RPM) load (FUEL), and the previous engine operating mode determined during the last cycle, i.e., 'last', the algorithm reviews the operating speed (rpm) and the previous engine operating mode (last). The decision logic operates as follows to first identify one of the zones, and then one of the sub-zones:

if RPM<$f_1$(FUEL) or (last<20 and RPM<$f_1$(FUEL)+$r_1$)

and, if FUEL<$h_{11}$(RPM) or (last<12 and FUEL<$h_{11}$(RPM)+$s_1$);

then the sub-zone is identified as sub-zone 11, and the combustion operating mode is set to the operating mode associated therewith.

Otherwise, the sub-zone is identified as sub-zone 12, and the combustion operating mode is set to the operating mode associated therewith.

However, if these conditions are not met, then:

if RPM<$f_2$(FUEL) or (last<30 and RPM<$f_2$(FUEL)+$r_2$)

and, if FUEL<$h_{21}$(RPM) or (last<22 and FUEL<$h_{21}$(RPM)+$s_2$);

then the sub-zone is identified as sub-zone 21, and the combustion operating mode is set to the operating mode associated therewith; otherwise, if RPM<$f_2$(FUEL) or (last<30 and RPM<$f_2$(FUEL)+$r_2$)

and, if FUEL<$h_{22}$(RPM) or (last<23 and FUEL<$h_{22}$(RPM)+$s_2$);

then the sub-zone is identified as sub-zone 22, and the combustion operating mode is set to the operating mode associated therewith. Otherwise, the sub-zone is identified as sub-zone 23, and the combustion operating mode is set to the operating mode associated therewith.

However, if these conditions are not met, then:

if RPM<$_3$(FUEL) or (last<40 and RPM<$f_3$(FUEL)+$r_2$)

and, if FUEL<$h_{31}$(RPM) or (last<32 and FUEL<$h_{31}$(RPM)+$s_2$);

then the sub-zone is identified as sub-zone 31, and the combustion operating mode is set to the operating mode associated therewith; otherwise, if RPM<$f_3$(FUEL) or (last<40 and RPM<$f_3$(FUEL)+$r_2$)

and, if FUEL<$h_{32}$(RPM) or (last<33 and FUEL<$h_{32}$(RPM)+$s_2$);

then the sub-zone is identified as sub-zone 32, and the combustion operating mode is set to the operating mode associated therewith. Otherwise, the sub-zone is identified as sub-zone 33, and the combustion operating mode is set to the operating mode associated therewith.

However, if these conditions are not met, then, the sub-zone is identified as sub-zone 41, and the combustion operating mode is set to the operating mode associated therewith.

The preferred combustion mode is determined based upon the speed/load sub-zone in which the engine is operating. The load functions $f_i$(LOAD) and the speed functions $h_{ij}$(RPM) to determine a sub-zone can be in the form of equations or pre-calibrated tables, derived based upon the information depicted in FIGS. 2 and 3. In operation, a zone is initially focused upon, prior to considering the whole boundary of a combustion mode at once. The algorithm is illustrated for two independent variables, speed (rpm) and load (fuel). It is understood that a third independent variable, e.g., engine operating temperature, can be included in this analysis with limited changes in the analytical framework or pre-calibration effort. In this manner, selective operation of the exemplary internal combustion engine can be controlled in one of the combustion modes.

The invention described hereinabove comprises the method for controlling operation of the internal combustion engine in the preferred combustion mode, based upon engine operation characterized in terms of the operating parameters of speed and load.

In an alternative embodiment, the method described hereinabove comprises engine operation characterized in terms of a plurality of engine operating parameters and described utilizing a multi-dimensional operating space. The multi-dimensional operating space is preferably defined in terms of parameters including engine speed and load, as previously described, and further includes one or more of engine parameters comprising engine temperature, ambient temperature, barometric pressure, and, elapsed running time to describe and define engine operation. The multi-dimensional space is separated into a plurality of multi-dimensional segments, with each segment having boundaries defined by thresholds for the engine operating parameters, analogous to that described above with regard to FIGS. 2A and 2B. A combustion mode is associated with each of the multi-dimensional segments, preferably during pre-production engine development and calibration. States for the engine operating parameters are determined, using the aforementioned sensors and other appropriate sensors or algorithms. One of the multi-dimensional segments is identified by iteratively selectively identifying successive subsets of the multi-dimensional segments using the logic as described with reference to FIG. 4 adapted to the multi-dimensional segments. This comprises, e.g., selecting a first subset of the segments based upon engine speed, then selecting a subset of the first subset of the segments based upon engine load, then selecting a subset of the second subset of the segments based upon engine temperature; then selecting a subset of the third subset of the segments based upon ambient pressure. This segmenting and selecting process is executed until a single one of the segments is identified. A preferred combustion mode is determined, comprising the combustion mode associated with the identified single one of the segments. Operation of the internal combustion engine is controlled to the preferred combustion mode, depending upon hysteresis factors, as previously described.

While the invention has been described by reference to certain embodiments, it should be understood that changes can be made within the spirit and scope of the inventive concepts described. Accordingly, it is intended that the invention not be limited to the disclosed embodiments, but that it have the full scope permitted by the language of the following claims.

The invention claimed is:

1. Method for selecting a preferred combustion mode for an internal combustion engine selectively operative in a plurality of combustion modes, comprising:

defining engine operation in terms of first and second parameters;

separating the engine operation into a plurality of zones, each zone having boundaries defined by thresholds for the first parameter;

separating each of the zones into a plurality of sub-zones, each sub-zone having boundaries defined by thresholds for the second parameter;

associating one of the combustion modes with each of the sub-zones, wherein said combustion modes comprising a single injection auto-ignition mode, a double injection auto-ignition mode, a spray-guided spark-ignition mode, and a homogeneous-charge spark-ignition mode;

determining states for the first and second parameters;

identifying one of the zones based upon the state for the first parameter;

identifying one of the sub-zones of the identified zone based upon the state for the second parameter; and, identifying a preferred combustion mode comprising the combustion mode associated with the identified sub-zone.

2. The method of claim 1, further comprising identifying the preferred combustion mode comprising the combustion mode associated with the identified sub-zone and hysteresis associated therewith.

3. The method of claim 1, wherein the first and second parameters comprise engine speed and engine load.

4. The method of claim 3, wherein separating the engine operation into a plurality of zones, each zone having boundaries defined by thresholds for the first parameter further comprises defining a first zone comprising the engine speed state ranging from a minimum idle speed to a first speed threshold defined by a minimum engine speed for auto-ignition combustion operation.

5. The method of claim 4, wherein the preferred combustion mode comprises a spray-guided spark-ignition mode in the first zone.

6. The method of claim 4, further comprising defining a second zone comprising the engine speed state ranging from the first speed threshold to a second speed threshold.

7. The method of claim 6, wherein the preferred combustion mode comprises the auto-ignition combustion mode when the engine load is less than a load threshold defined by a maximum engine load for auto-ignition combustion operation and the engine speed is between the first and second speed thresholds.

8. The method of claim 6, further comprising defining a third zone comprising engine speed state ranging from the second speed threshold to a third speed threshold defined by a maximum engine speed for auto-ignition combustion operation.

9. The method of claim 8, further comprising a fourth zone comprising an engine speed state greater than the maximum engine speed for auto-ignition combustion operation.

10. The method of claim 9, wherein the preferred combustion mode comprises homogeneous spark-ignition mode when the engine speed exceeds the maximum engine speed for auto-ignition combustion operation.

11. Method for controlling operation of an internal combustion engine selectively operative in one of a plurality of engine combustion modes, comprising:

defining an engine operating region in terms of first and second parameters; the engine operating region separated into a plurality of zones based upon the first parameter; each of the zones separated into a plurality of sub-zones based upon the second parameter;

associating one of the combustion modes with each of the sub-zones, wherein said combustion modes comprise a single injection auto-ignition mode, a double injection auto-ignition mode, a spray-guided spark-ignition mode, and a homogeneous spark-ignition mode;

monitoring engine operation to determine states for the first and second parameters;

identifying one of the plurality of zones based upon the state for the first parameter, and, identifying one of the plurality of sub-zones of the identified zone based upon the state for the second parameter;

identifying a preferred combustion mode comprising the combustion mode associated with the identified sub-zone; and, controlling engine operation in the preferred combustion mode.

12. The method of claim 11, wherein controlling engine operation in the preferred combustion mode further comprises controlling one of fuel injection timing and mass, spark ignition energy and timing, and opening and closing timings of intake and exhaust valves.

13. The method of claim 11, further comprising identifying the preferred combustion mode based upon the combustion mode associated with the identified sub-zone and hysteresis associated therewith.

14. The method of claim 11, wherein the first and second parameters comprise engine speed and engine load.

15. Method for operating an internal combustion engine, the engine selectively operative in a plurality of combustion modes, comprising:

characterizing engine operation in terms of a multi-dimensional space, each dimension defined by one of a plurality of engine operating parameters;

separating the multi-dimensional space into a plurality of multi-dimensional segments, each segment having boundaries defined by thresholds for the engine operating parameters;

associating one of the combustion modes with each of the multi-dimensional segments, wherein the combustion modes comprise a single injection auto-ignition mode, a double injection auto-ignition mode, a spray-guided spark-ignition mode, and a homogeneous-charge spark-ignition mode;

determining states for the engine operating parameters;

identifying one of the segments by iteratively selectively identifying successive subsets of the multi-dimensional segments, each successive subset selected based upon the state of one of the engine operating parameters;

identifying a preferred combustion mode comprising the combustion mode associated with the identified one of the segments; and, controlling operation of the internal combustion engine in the preferred combustion mode.

16. The method of claim 15, further comprising identifying the preferred combustion mode comprising the combustion mode associated with the identified one of the segments and hysteresis associated therewith.

17. The method of claim 15, wherein the plurality of engine parameters comprise one or more of: engine speed, engine load, engine temperature, ambient temperature, barometric pressure, and, elapsed running time.

* * * * *